US005626002A

United States Patent [19]

Ford et al.

[11] Patent Number: 5,626,002

[45] Date of Patent: May 6, 1997

[54] PACKAGING MACHINE HAVING OVERHEAD ASSEMBLY FOR OPENING AND LOWERING CARTON ONTO ARTICLE GROUPS

[75] Inventors: Colin P. Ford, Woodstock, Ga.; Allen L. Olson, Crosby, Minn.; James W. Emerson, Woodstock, Ga.

[73] Assignee: Riverwood International Corporation, Atlanta, Ga.

[21] Appl. No.: 570,308

[22] Filed: Dec. 11, 1995

[51] Int. Cl.[6] ..... B65B 21/22; B65B 43/26; B65B 5/06

[52] U.S. Cl. ..... 53/398; 53/48.1; 53/48.7

[58] Field of Search ..... 53/48.1, 48.7, 53/48.8, 48.9, 398, 539, 534, 242, 247

[56] References Cited

U.S. PATENT DOCUMENTS

| | | | |
|---|---|---|---|
| 3,415,033 | 12/1968 | Perry et al. | 53/48.9 X |
| 3,698,151 | 10/1972 | Arneson | 53/48.1 X |
| 3,751,872 | 8/1973 | Helms | 53/48.1 X |
| 3,848,519 | 11/1974 | Ganz | 53/48.1 X |
| 3,940,907 | 3/1976 | Ganz | 53/48.1 |
| 4,100,715 | 7/1978 | Ganz | 53/48.9 X |
| 4,802,324 | 2/1989 | Everson | 53/48.1 X |

*Primary Examiner*—Horace M. Culver

[57] ABSTRACT

A packaging machine places cartons on an carton conveyor in an inverted-T configuration with the panels of the carton being generally horizontal and the walls of the carton collapsed together in a generally vertical orientation. An overhead assembly has carrier assemblies for picking up the cartons, opening the cartons, and lowering the cartons onto article groups. Each carrier assembly has a pair of opening members with protruding fingers for insertion within cut-outs formed in the cartons. After a carrier assembly has engaged a carton in an inverted-T configuration, one of the opening members in the carrier assembly is moved away from the other opening member, thereby opening the carton. Each carrier assembly has cam followers which travel within three cam plates, one for controlling an orientation of the carrier assembly, one for supporting the carrier assembly, and one for opening and closing the opening members. The overhead assembly is substantially located on only one side of the articles and cartons and thus provides easy access for repairs, maintenance, or removal of article or cartons jams. The packaging machine can package articles of various sizes and configurations into various types of cartons. In general, the packaging machine can package articles into any type of carton having panels opposite each other which may be engaged and lowered onto an article group. The packaging machine can also operate at fairly high speeds since cartons are positively and quickly opened by the movement of the opening members.

36 Claims, 9 Drawing Sheets

PACKAGING MACHINE HAVING OVERHEAD ASSEMBLY FOR OPENING AND LOWERING CARTON ONTO ARTICLE GROUPS

FIELD OF THE INVENTION

The invention generally relates to a packaging machine having an assembly for opening and then lowering cartons onto an article group and, more particularly, to a packaging machine having an overhead assembly for receiving cartons in a predetermined configuration and for opening and lowering the cartons onto article groups.

BACKGROUND OF THE INVENTION

In a typical packaging machine for placing groups of articles, such as bottles or cans, within individual cartons, the cartons are stacked in a collapsed form in a supply hopper at one end of the packaging machine. The collapsed cartons, otherwise known as carton blanks, are individually removed by a carton selecting mechanism or feeder, such as a rotary feeder, and placed on one or more carton carriers, such as lugs, that travel in a direction parallel to the flow of articles. With one type of packaging machine, the cartons are placed between adjacent pairs of carton carriers. The carton selecting mechanism has vacuum cup assemblies for extracting a leading carton blank in the stack and for releasing the carton after the carton has been positioned between the carton carriers. The carton blanks become opened by centrifugal force upon rotation of the vacuum assemblies away from the stack and toward the carriers, by moving the carton against static guides, or by the contact of the carton with the traveling carriers.

One or more chains or belts move the cartons in a downstream direction in synchronism with the operation of the feeder so that the cartons are placed on the one or more carriers, such as between adjacent pairs of the lugs. The cartons are supported by the carriers such that two side walls of each carton are parallel to the length of the carriers, the front and rear walls are parallel to the direction of article flow, and the two bottom panels respectively depend from the front and rear walls. As the cartons are moved in the downstream direction, a cam mechanism bends the bottom panels away from each other up to an approximate angle of ninety degrees relative to the front and rear walls of the carton.

It should be understood that the naming of the various walls or panels of a carton vary with the size, shape, and style of the carton. In the above-identified carton, the walls and panels of a carton are defined such that, when the carton is in an assembled state holding articles, the front and rear walls of the carton are vertically oriented and extend along the length of the article group, the side walls are vertically oriented and extend along the width of the article group, and the bottom panels are horizontally oriented and extend underneath the article group.

After the bottom panels have been placed in a horizontal orientation by the cam mechanism, a second set of carriers forces the cartons along a set of rails down onto the articles. The second set of carriers typically has at least one lug for engaging a top portion of the carton so that the carton may be pulled from the top and one or more additional lugs for protruding through cut-outs in both of the bottom panels so that the carton may be pulled from the bottom. The walls of the carton remain in a generally vertical orientation as the carton is pulled along the rails by the second set of carriers.

The second set of carriers lowers the carton onto an article group and releases the carton at which time the bottom panels drop down to a vertical orientation. As the carton is travelling downstream with the article group, a second cam mechanism bends the bottom panels of the carton up underneath the articles and the bottom panels are fastened to each other, such as by glue or interlocking members on the bottom panels.

The above-described packaging machine has several disadvantages and/or limitations. For instance, the typical packaging machine is limited to cartons which are 'four crease' cartons. A 'four crease' carton only has four vertical creases or bends with each bend being located at one of the four corners of the carton. When a 'four crease' carton is flattened into a carton blank, the front wall and one side wall form one planar portion and the rear wall and other side wall form a second planar portion parallel to and connected to the first planar portion. Also, with a carton blank, the bottom walls depend down from the front and rear walls and are offset relative to each other. The packaging machine is limited to 'four crease' cartons since the cartons are opened by centrifugal force or by contacting the cartons with static guides or with the lugs. Other cartons, such as a 'six crease' carton which has additional vertical bends down the center of the two side walls, might not fully open upon rotation of the carton from the supply hopper to the traveling carriers. Because the packaging machine is limited to 'four crease' cartons, the packaging machine is rather restricted in the types of cartons that can be used in packaging articles. For instance, the above-described packaging machine would be unable to place articles within any type of carton which is formed from a carton blank having front and rear walls are opposite each other, such as with clips, wraps, tamper evident cartons, or neck-through cartons. It is therefore a desire in the industry to be able to package articles into a wider variety of carton types.

The placement of the carton blanks in the supply hopper presents another difficulty with the typical packaging machine. The carton blanks are generally planar and are typically positioned within the supply hopper with one of the bottom panels resting on the bottom of the supply hopper. Since the bottom panels are typically of unequal length, the weight of the front and rear walls and the two side walls is resting entirely upon only one of the two bottom panels. The bottom panels, however, are rather weak structurally and can easily collapse or become damaged due to the weight of the carton blank while supplied into the feeder by a magazine. A damaged or collapsed carton interrupts and impedes the packaging process.

The typical packaging machine is unable to operate at relatively high speeds since the packaging machine can operate only as fast as the feeder can select and open the carton blanks. For the packaging machines that open cartons by centrifugal force, the feeder is limited by the action of the centrifugal force or by the static guides or lugs. For instance, if the feeder is rotated at too high of a speed, the centrifugal force generated by the rotation of the vacuum assemblies would quickly open the cartons and would also close the cartons before they reach the carriers. Since the cartons would be at least partially closed upon reaching the traveling carriers, the carriers would be unable to receive the carton from the vacuum assembly. The packaging machine is therefore unable to operate at fairly high speeds.

The typical packaging machine is unable to positively open the cartons. The opening methods by which a typical packaging machine operates do not ensure that the carton will open and, instead, frequently cause a carton to misfeed due to the carton being folded inwardly or to the carton collapsing. The effectiveness of these opening methods depends in part on certain carton characteristics, such as the stiffness, rigidity, age, and crease strength of the carton. Thus, for many cartons, one or more of these characteristics would prevent the packaging machine from being able to package articles into these cartons. The reliability of these opening methods also depends partially upon the quality of the cartons. A carton with a low quality, such as one which has glue spattered between the walls or has incomplete cuts, would not open with these opening methods. Thus, a need exists for a packaging machine which can positively open cartons.

As another disadvantage, the traveling cartons, articles, and related machinery are fairly difficult to access. As stated above, the cartons are moved in the downstream direction by two sets of traveling carriers. The first set of traveling carriers receives the cartons from the carton feeder and contacts the two side walls of each carton while the second set of traveling carriers engages the bottom panels on either side of each carton as well as the top portion of each carton. The two sets of carriers, as well as the chains and other elements for moving the carriers, are positioned on either side and above the cartons and thus limit the amount of access to the cartons, articles, and related machinery. The cartons also encounter two different cam mechanisms while traveling in the downstream direction. Each of these cam mechanisms complicates the packaging machine and also further restricts the amount of access to the cartons. This limited amount of access to the cartons and bottles is highly detrimental to the operation of the packaging machine. For instance, when operation of the packaging machine is interrupted because of a carton jam or an article jam, the limited amount of access to the cartons, articles, carriers, and related elements may complicate a clean out operation and can significantly increase the amount of down time. The limited amount of access to the related machinery also complicates and increases the time needed to perform necessary maintenance or to perform repairs.

Thus, a need therefore exists in the industry for a packaging machine that can package articles of various sizes into a wider variety of carton types and sizes and one that positively opens the cartons. A need also exists for a packaging machine in which the cartons, articles, and related machinery are more easily accessed. Further, a need exists for a packaging machine which stacks carton blanks in a manner that improves the control of the cartons into the feeder. Moreover, a need exists for a packaging machine which can operate at higher speeds.

SUMMARY OF THE INVENTION

The invention, in one aspect, comprises a carrier assembly which receives cartons in a predetermined configuration in which the carton has a central portion and panels disposed on either side of the central portion. The career assembly has a pair of opening members and the carrier assembly engages a carton by engaging the panels with the opening members. Preferably, each opening member has one or more features, such as fingers, for insertion with cut-outs formed in the panels of the carton. The carrier assembly travels in a downstream direction with the carton and carries the carton away from a carton conveyor and down onto a group of articles. Before the carton is placed on an article group, the carrier assembly opens the carton by moving one opening member away from the other opening member.

A packaging machine preferably comprises a plurality of carrier assemblies which rotate about an overhead assembly. Each carrier assembly can pivot about a carrier shaft and is rotated about the overhead assembly by a chain drive. The overhead assembly has a set of three cam plates and each carrier assembly has three set of cam followers for respectively controlling the attitude of the carrier assembly, the spacing between the opening members, and for supporting the carrier assemblies on the overhead assembly. The attitude of the carrier assembly is maintained so that the opening members are in a vertical orientation from the time that a carton is engaged by a carrier assembly to the time that the carton is placed on an article group and released by the opening members. The spacing of the opening members is varied from a spacing of about one inch during the phase that the opening members are lowered on either side of a carton, down to a fairly close spacing while the opening members engage a carton, and then to a spacing which opens the carton after engagement prior to the placement of the carton on an article group.

A packaging machine according to the invention having the overhead assembly and carrier assemblies is capable of packaging articles of various sizes and configurations into cartons of various types. The packaging machine positively opens cartons and can open virtually any carton which has panels opposite each other and which can be engaged and lowered down onto articles by the packaging machine according to the invention. The packaging machine can also operate at fairly high speeds since the opening of the cartons is not limited by the properties of centrifugal force or by contact with another element. Additionally, the overhead assembly according to the invention has a cantilevered design in which substantially most of the components of the overhead assembly are located on one side of the articles. Because the overhead assembly does not impede access to the cartons and articles, necessary repairs, scheduled maintenance, and removal of carton or article jams can be performed more easily and quickly, thereby reducing the amount of down time and increasing the efficiency of the packaging machine.

DETAILED DESCRIPTION OF THE PREFERRED EMBODIMENTS

Figure 1:
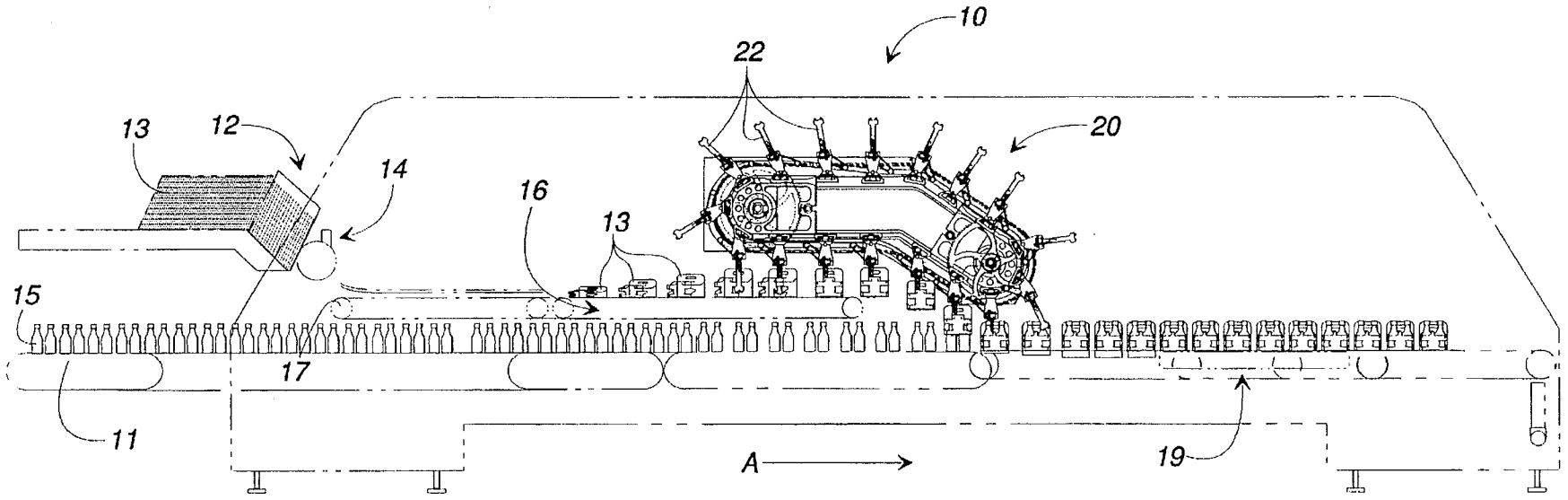
FIG. 1 is a partial side view of a packaging machine according to a preferred embodiment of the invention.

With reference to FIG. 1, a packaging machine 10 according to a preferred embodiment of the invention, has articles 15, such as bottles or cans, moving in a downstream direction indicated by the arrow A. In general, the articles 15 are transported and separated into individual article groups on a conveyor 11 and a carton 13 is lowered onto each article group. The cartons 13 are stacked within a supply hopper 12, which is located at an upstream end of the packaging machine 10 and a selecting apparatus 14 successively removes each carton 13 from the supply hopper 12 and places the carton 13 onto a carton conveyor 17. A carton transport assembly 16 receives the cartons 13 from the carton conveyor 17 and places the cartons 13 in a predetermined configuration, which in this example is an inverted-T configuration in which the walls of the carton 13 are substantially vertically oriented and compressed together and the bottom panels of the carton 13 are substantially horizontally oriented and rest upon the assembly 16 on either side of the upright walls. An overhead assembly 20 has a plurality of carton carriers 22 for engaging the cartons 13 on the assembly 16, for completely opening the cartons 13, and for lowering the cartons 13 onto individual article groups. At a location downstream from the overhead assembly 20, a closing assembly 19 fastens the bottom panels together so that each group of articles 15 is securely held within one of the cartons 13.

The supply hopper 12 stacks the cartons 13 together on their sides so that the top of the carton 13 is located on one side of the packaging machine while the bottom is located on the other side of the packaging machine 10. In other words, each carton rests upon one or more of the creases rather than upon a single bottom panel. The supply hopper 12 has a tab or other type of projection for limiting movement of the stack of cartons 13 and may also have a mechanism or assembly for advancing the cartons 13 toward the tab while the cartons 13 are being removed by the selecting apparatus 14. Because the cartons 13 do not rest upon their bottom panels, the cartons 13 are not subject to collapsing within the supply hopper 12. Although the supply hopper 12 preferably orients the cartons 13 on their sides, the supply hopper 12 does not form any part of the invention and any suitable assembly for stacking cartons 13 may be used.

The selecting apparatus 14, the carton transport assembly 16, the carton conveyor 17, and the closing assembly 19 also do not form any part of the present invention. The selecting apparatus 14 may comprise a rotary feeder having vacuum assemblies for contacting and removing the cartons 13 from the supply hopper 12 and for placing the cartons 13 onto the conveyor 17. The carton transport assembly 16 and the conveyor 17 preferably place the cartons 13 in the inverted-T configuration by positioning the walls in a vertical orientation while maintaining the bottom panels in the horizontal orientation and then swinging one of the bottom panels through one hundred eighty degrees so that the bottom panels are horizontally located on either side of the walls. The carton transport assembly 16 presents the cartons 13 to the overhead assembly 20 in this inverted-T orientation. It should be understood that the invention can be operated with any suitable selecting apparatus, transport assembly, or closing assembly.

Figure 2:
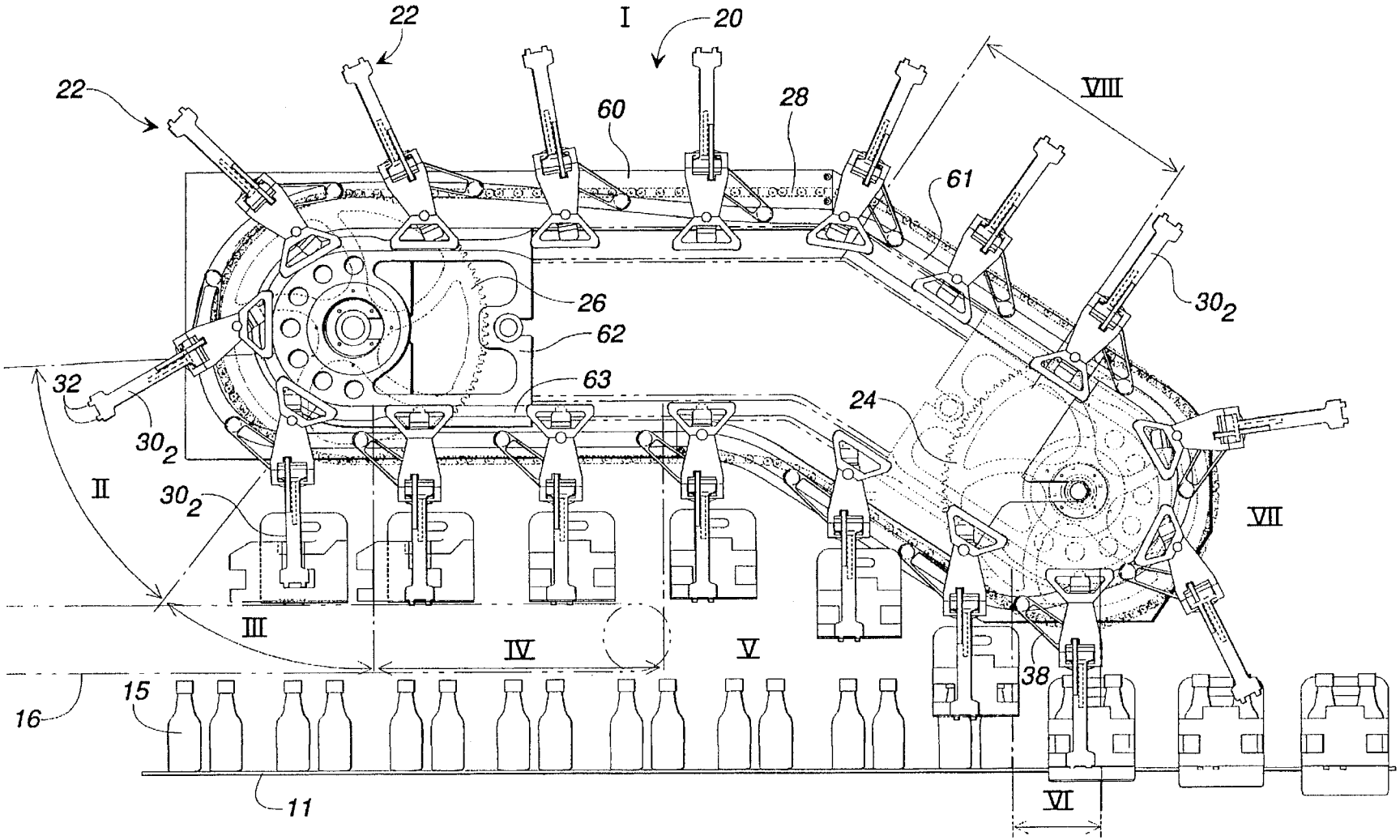
FIG. 2 is an enlarged partial side view of an overhead assembly for opening and closing cartons.

The overhead assembly 20, as better seen in FIG. 2, has an endless chains 28 looped partially around a set of sprockets 24 and 26 with sprockets 24 being drive sprockets and sprockets 26 providing tension on the chains 28. Each of the carrier assemblies 22 forming the overhead assembly 20 is attached to the chains 28 and travels in a counterclockwise direction about the overhead assembly 20 from the viewing angle of FIG. 2.

Figure 3:
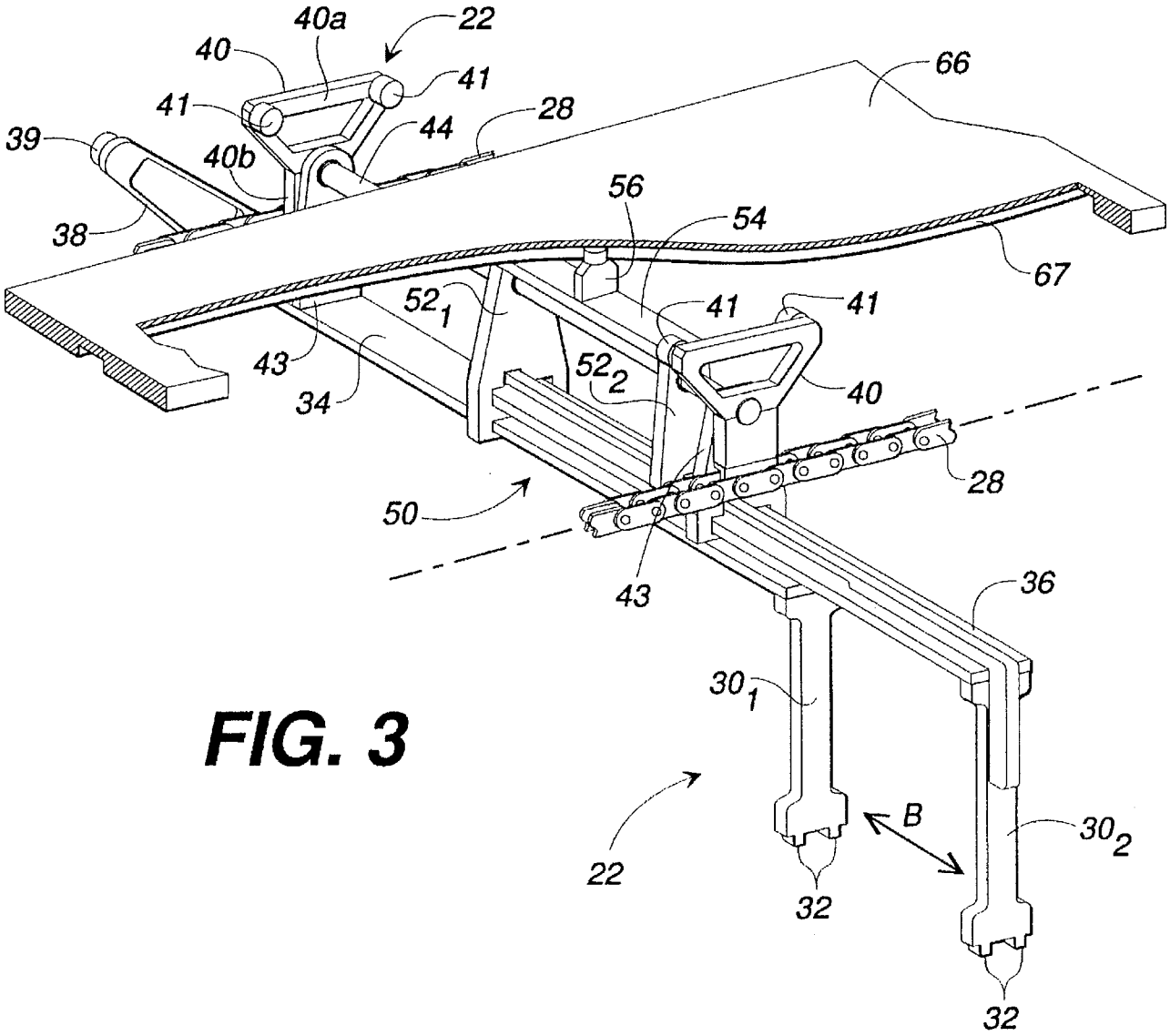
FIG. 3 is a partial perspective view of a carrier assembly in FIGS. 1 and 2.
Figure 4:
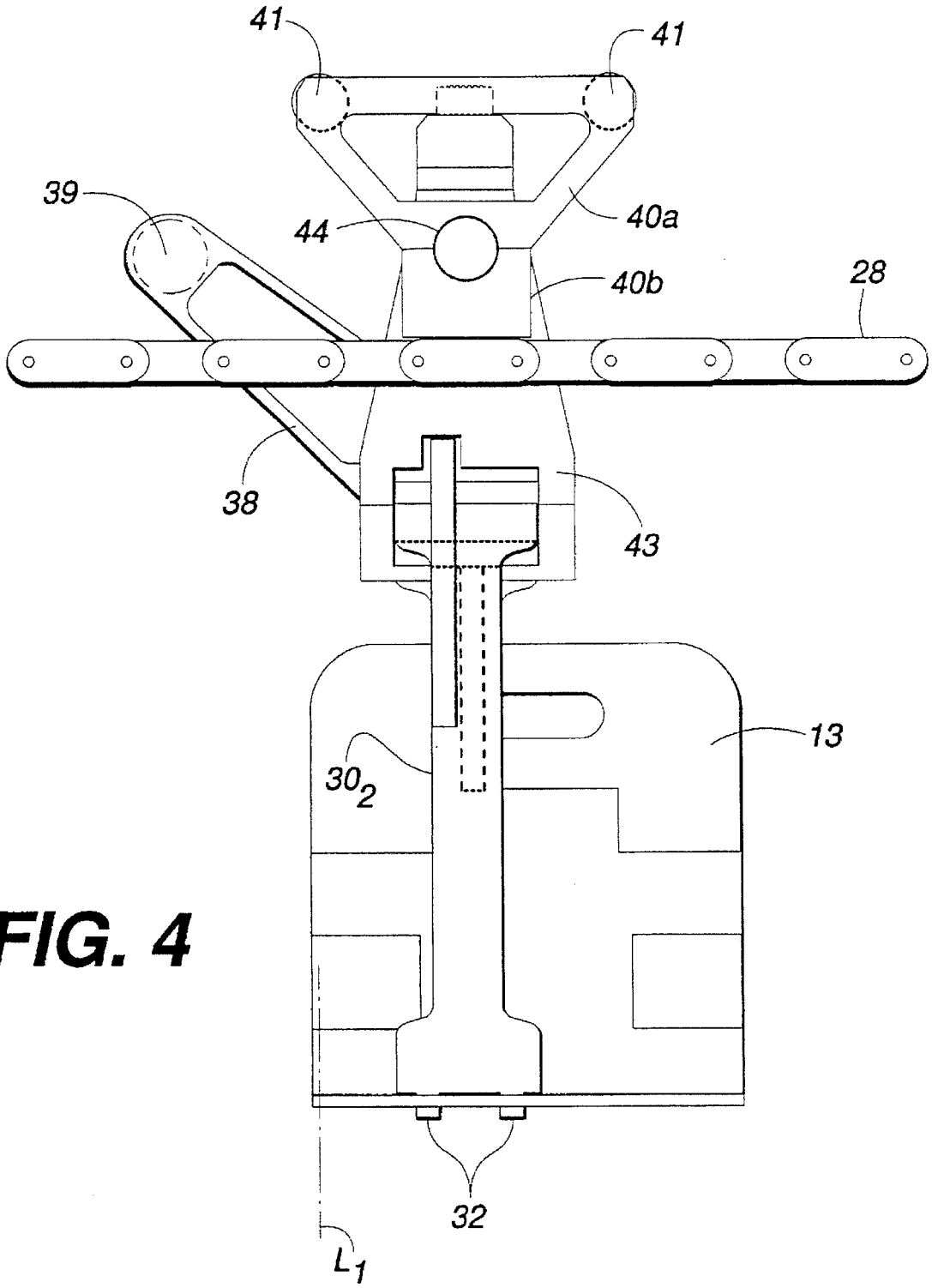
FIG. 4 is a side view of the carrier assembly engaged with a carton.

With reference to FIGS. 3 and 4, each carrier assembly 22 has a pair of opening members $\mathbf{30}_1$ and $\mathbf{30}_2$ for engaging a carton 13 and for lowering the carton 13 onto an article group. A first one of the opening members $\mathbf{30}_1$ is fixed in position while the second opening member $\mathbf{30}_2$ is movable along axis B. The fixed opening member $\mathbf{30}_1$ is attached to, and depends from, a fixed carrier bar 34 while the movable opening member $\mathbf{30}_2$ is attached to, and depends from, a movable carrier bar 36. The distance between the two opening members $\mathbf{30}_1$ and $\mathbf{30}_2$ can therefore be adjusted by moving the movable carrier bar 36 along the fixed carrier bar 34 along axis B.

Each carrier assembly 22 also has a yoke assembly 50 which controls the movement of the carrier bar 36 and opening member $\mathbf{30}_2$ along axis B. The yoke assembly 50 has two upright members $\mathbf{52}_1$ and $\mathbf{52}_2$ which are joined at their tops by a horizontal member 54, which are connected at their bottoms to the moveable carrier bar 36, and which have slots through which the carrier bar 34 passes. Since the first and second upright members $\mathbf{52}_1$ and $\mathbf{52}_2$ are not attached to the carrier bar 34, the yoke assembly 50 and moveable carrier bar 36 are capable of sliding along the fixed carrier bar 34 along axis B. An opening cam follower 56 is attached to the horizontal member 54 and is inserted within a groove 67 formed in an opening cam plate 66. The opening cam plate 66 is shown in partial view in order to clearly illustrate the elements of the carrier assembly 22. It should be understood, however, that the opening cam follower 56 is bound on either side by the opening cam plate 66 and is confined to travel along the path of the groove 67. Thus, as the cam follower 56 moves along axis B due to the contour of the groove 67, the yoke assembly 50 and the opening member $\mathbf{30}_2$ move along axis B, thereby adjusting the distance between the opening members $\mathbf{30}_1$ and $\mathbf{30}_2$.

A pair of support members 40 are located on the outer sides of the cam plates 62 and are attached to the chains 28. Each support member 40 has a pair of support followers 41 for being received within a cam groove 63 in one of the cam plates 62, shown in FIG. 2. The pair of support members 40 supports an individual carrier assembly 22 as the assembly 22 is being rotated about sprockets 24 and 26 on the overhead assembly 20. The support members 40 are attached to the chains 28 by suitable brackets (not shown) and thus receive the driving force for rotating the carrier assemblies 22 about the overhead assembly 20. It should be understood that a packaging machine according to the invention need not operate with the support followers 41, cam plates 62, and cam grooves 63, such as a packaging machine operating at lower speeds or one with lighter carrier assemblies 22.

Each carrier assembly 22 also has a carrier shaft 44 about which the carrier assembly 22 may pivot. The carrier shaft 44 extends between the two support members 40 and passes through the yoke assembly 50. Each support member 40 is comprised of an upper member $\mathbf{40}_a$, upon which the support followers 41 are attached, and a lower member $\mathbf{40}_b$, which is attached to the chains 28. The carrier shaft 44 extends through both the upper and lower members $\mathbf{40}_a$ and $\mathbf{40}_b$ of the support members 40 and is received within beatings in members 43. The members 43 are able to pivot relative to the support members 40 whereby the fixed carrier bar 34, the movable carrier bar 36, the opening members $\mathbf{30}_1$ and $\mathbf{30}_2$, and the yoke assembly 50 are all capable of pivoting as a unit about the carrier shaft 44.

The pivoting of the carrier assembly 22 about the carrier shaft 44 is controlled by an attitude member 38 which is securely attached to one end of the fixed carrier bar 34 and which projects at an angle away from the carrier bar 34. A cam follower 39 is attached to the end of the attitude member 38 and is inserted within a cam groove 61 in a cam plate 60, shown in FIG. 2. As the carrier assembly 22 rotates about the overhead assembly 20, the distance between the attitude member 38 and the cam followers 41 is varied by the positions of the cam grooves 61 and 63 so as to vary the placement of the attitude member 38 relative to the cam followers 41. A variation in the distance between the cam grooves 61 and 63 causes the carrier assembly 22 to pivot about the carrier shaft 44. The pivoting of the carrier assembly 22 is significant for the proper handling of the cartons 13, as will be more apparent from the description below.

Figure 5:
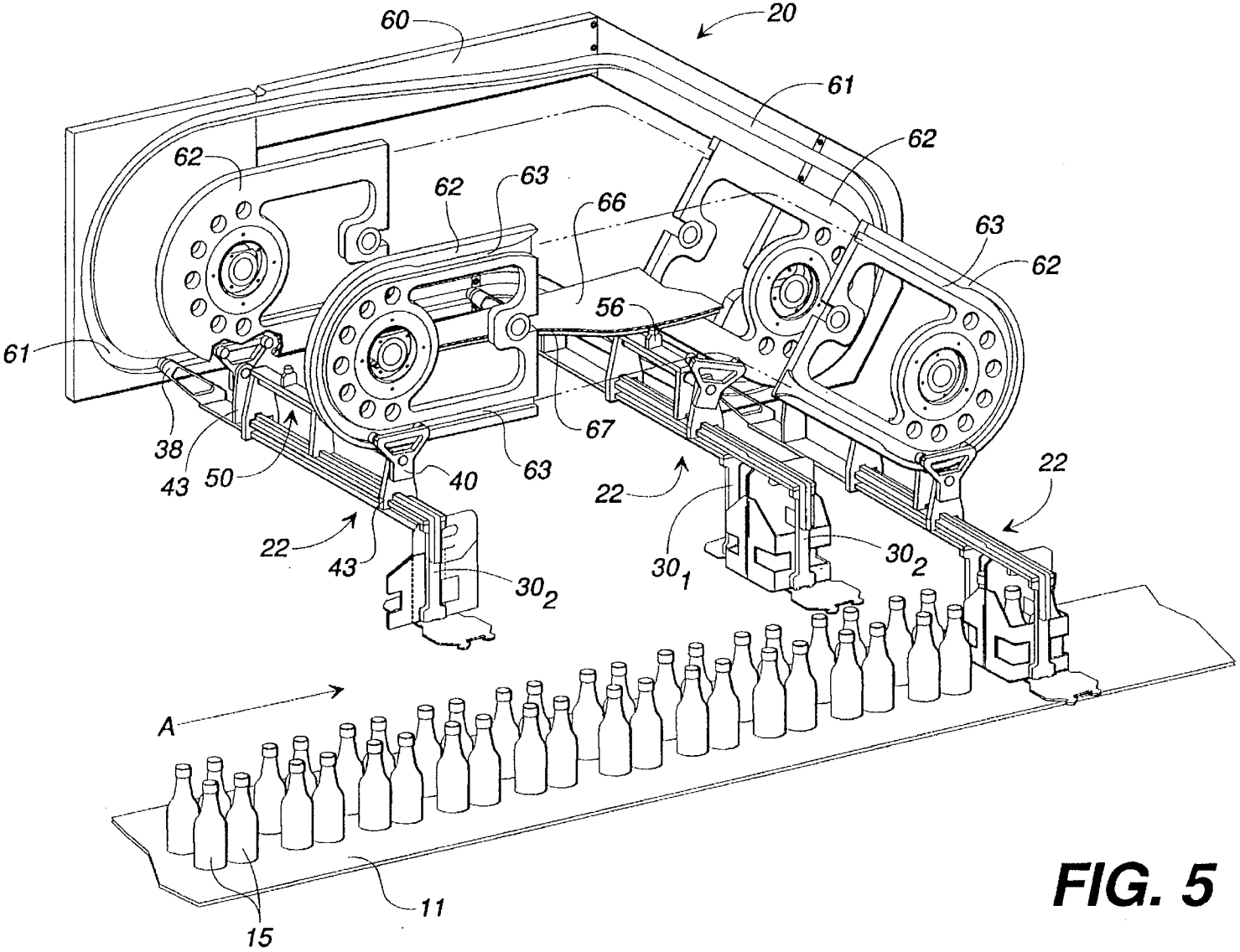
FIG. 5 is a partial cut-away perspective view of the overhead assembly of FIGS. 1 and 2.
Figure 8:
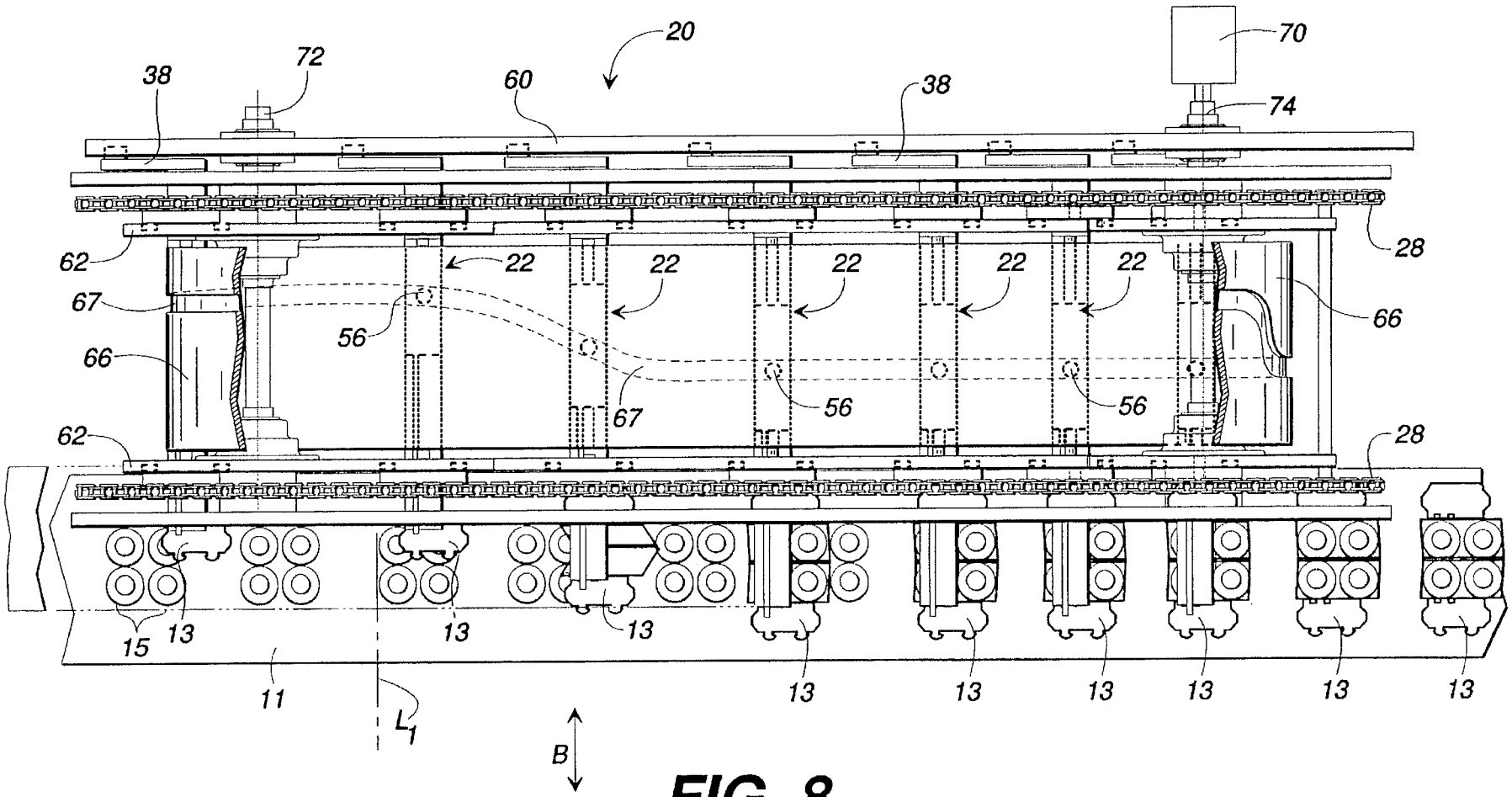
FIG. 8 is a top cut-away view of the overhead assembly of FIG. 2.

With reference to FIGS. 2, 5, and 8, a motor 70 or other suitable type of drive mechanism is attached to a drive shaft 74 which extends across the downstream end of the overhead assembly 20. The motor 70 need not be directly connected to the shaft 74 but may drive the shaft 74 through an intermediate element or elements, such as a gear box. The drive sprockets 24 are attached to the drive shaft 74 while the other sprockets 26 are attached to an idler shaft 72 which extends across the overhead assembly 20 at an upstream end of the overhead assembly 20. When the sprockets 24 and shaft 74 rotate, the chains 28, and thus all of the carrier assemblies 22, rotate in the counter-clockwise direction about the overhead assembly 22 from the viewing angle of FIG. 2.

As shown in these figures, the support of the carrier assemblies 22 as they rotate about the overhead assembly 20, the pivoting of the assemblies 22 about carrier shaft 44, and the opening of the members $\mathbf{30}_1$ and $\mathbf{30}_2$ are controlled by three separate sets of cam followers and cam grooves. The support followers 41 on support members 40 are received within cam grooves 63 of cam plates 62, support the carrier assemblies 22 on the overhead assembly 20, and are attached to the chain 28 which causes the carrier assemblies 22 to rotate about the overhead assembly 20. The attitude member 38 is received within cam groove 61 of cam plate 60 and controls the orientation or pivoting of the carrier assemblies 22 relative to carrier shaft 44. The opening cam follower 56 on yoke assembly 50 on each of the carrier assemblies 22 follows the path of cam groove 67 in opening cam plate 66 and controls the opening or closing of the members $\mathbf{30}_1$ and $\mathbf{30}_2$.

In a first zone I of operation, with reference to FIG. 2, the opening members $\mathbf{30}_1$ and $\mathbf{30}_2$ in a carrier assembly 22 do not come in contact with any cartons 13 and can therefore be spaced apart from each other at virtually any distance. At the end of the first zone I of operation, however, the opening members $\mathbf{30}_1$ and $\mathbf{30}_2$ are preferably spaced apart a distance of approximately one inch so that the opening members $\mathbf{30}_1$ and $\mathbf{30}_2$ do not damage or otherwise contact the carton 13 as the members $\mathbf{30}_1$ and $\mathbf{30}_2$ are swung around and down on either side of the carton 13. When the carrier assembly 22 enters a second zone II of operation, the opening members $\mathbf{30}_1$ and $\mathbf{30}_2$ are lowered on either side of a carton 13 and are closed from a spacing of about one inch into fairly close proximity to the carton 13.

Figure 6:
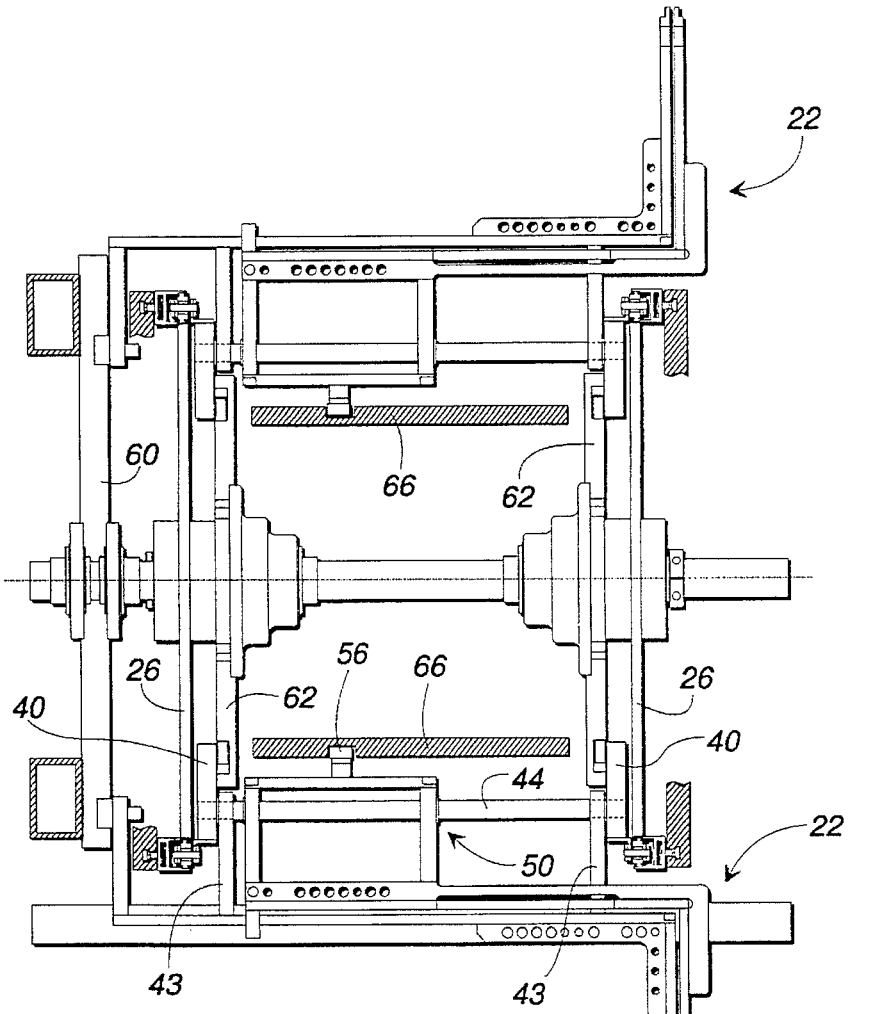
FIG. 6 is a front view of the overhead assembly of FIG. 1 with a carrier assembly in a fully closed position above an article group.
Figure 7:
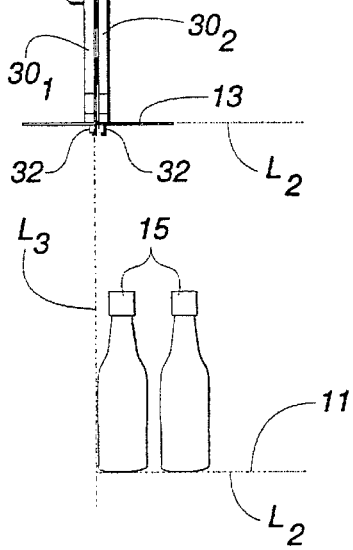
FIG. 7 is an enlarged partial view illustrating an insertion of opening members into cut-outs in a carton.
Figure 7:
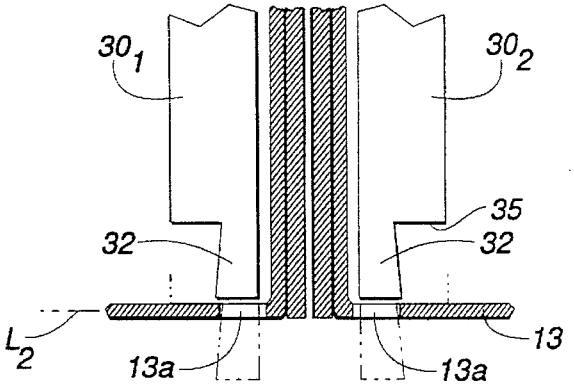

In a third zone III of operation, the opening members $\mathbf{30}_1$ and $\mathbf{30}_2$ are vertically oriented due to the placement of the attitude member 38 and are lowered into engagement with the carton 13. As best seen in FIGS. 6 and 7, the opening members $\mathbf{30}_1$ and $\mathbf{30}_2$ have features 32, which are preferably fingers that are inserted within cut-outs 13*a* formed in the bottom panels of the carton 13. The spacing of the opening members $\mathbf{30}_1$ and $\mathbf{30}_2$ in the second II zone of operation should therefore be selected so as to align the fingers 32 with the locations of the cut-outs 13*a*. The fingers 32 of the opening members $\mathbf{30}_1$ and $\mathbf{30}_2$ are preferably shaped so that an upper surface of the carton 13 near the cut-outs 13*a* contacts a planar surface 35 on the opening members $\mathbf{30}_1$ and $\mathbf{30}_2$. The planar surface 35 contacts the carton 13 and prevents the carton 13 from sliding up the opening members $\mathbf{30}_1$ and $\mathbf{30}_2$ as the carton 13 is being lowered onto a group of articles 15. The wedged shape or other retaining profile of the fingers 32 also prevents the carton 13 from falling down and becoming released from the fingers 32 and opening members $\mathbf{30}_1$ and $\mathbf{30}_2$ while the carton 13 is being transported, opened, and lowered onto a group of articles 15.

As the carrier assembly 22 moves within a fourth zone IV of operation, as best seen in FIG. 8, the cam groove 67 is shaped such that the opening cam follower 56 is moved along axis B to separate the movable opening member $\mathbf{30}_2$ from the fixed opening member $\mathbf{30}_1$ by a distance of approximately twice the outer diameter of the articles 15. It should be understood that the amount in which the carton is opened depends upon the width of the articles 15 in a group in a direction along axis B. Thus, if the article diameter is 2 inches, the opening members $\mathbf{30}_1$ and $\mathbf{30}_2$ would have to be separated approximately four inches if running a two lane application.

Figure 9:
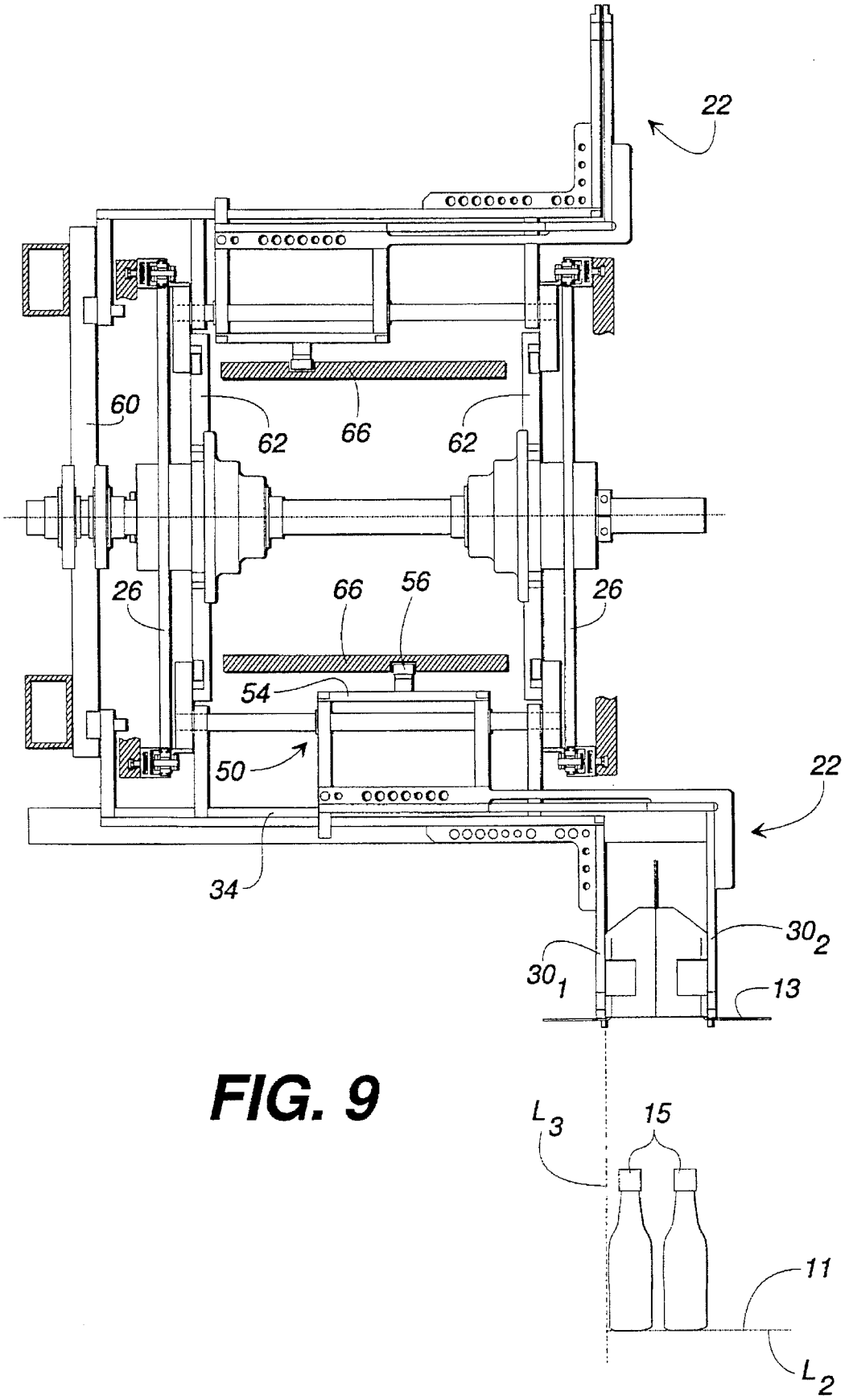
FIG. 9 is a front view of the overhead assembly of FIG. 1 with a carrier assembly in a fully opened position above an article group.

After the carton 13 has been completely opened in the fourth zone IV of operation, the carton 13 is carded away from the carton transport assembly 16 in a fifth V zone of operation and is lowered onto a group of articles 15 by the carrier assembly 22. As shown in FIG. 9, the bottom panels of the carton 13 can remain in a horizontal orientation even after the fingers 32 of the opening members $\mathbf{30}_1$ and $\mathbf{30}_2$ have engaged the carton 13 and after the carton 13 has left the carton transport assembly 16.

As best shown by FIGS. 2 and 8, the groups of articles 15 are at a certain fixed pitch, such as 12.5 inches, while the carrier assemblies 22 are initially at a larger pitch, such as 15 inches to accommodate the flat carton length. When the carrier assemblies 22 enter the fifth zone V of operation, the carrier assemblies 22 travel down toward the articles 15 at an angle which adjusts the pitch of the carrier assemblies 22 to equal the pitch of the articles 15, which is a reduced pitch of 12.5 inches. The reduction in pitch is achieved by the angle at which the carrier assemblies 22 descend and the maintaining of a vertical attitude due to cam follower 38. While the linear speed of the cartons 13 is matched to the linear speed of the article groups in the fifth V zone due to the descent of the carrier assemblies 22, an additional amount of speed matching must occur between the opening members $\mathbf{30}_1$ and $\mathbf{30}_2$ and the article groups in the area approximated by the sixth VI zone. This additional amount of speed matching is necessary due to the travel of the chains 28 about the sprockets 24. By matching pitch of the carrier assemblies 22 to the pitch of the article groups, the throughput of the packaging machine 10 is thus maximized since the machine 10 operates at the smallest pitch dependent on product size. As is apparent from FIG. 8, the cartons 13 are therefore properly positioned relative to the articles 15 in the fifth V zone of operation.

Figure 10:
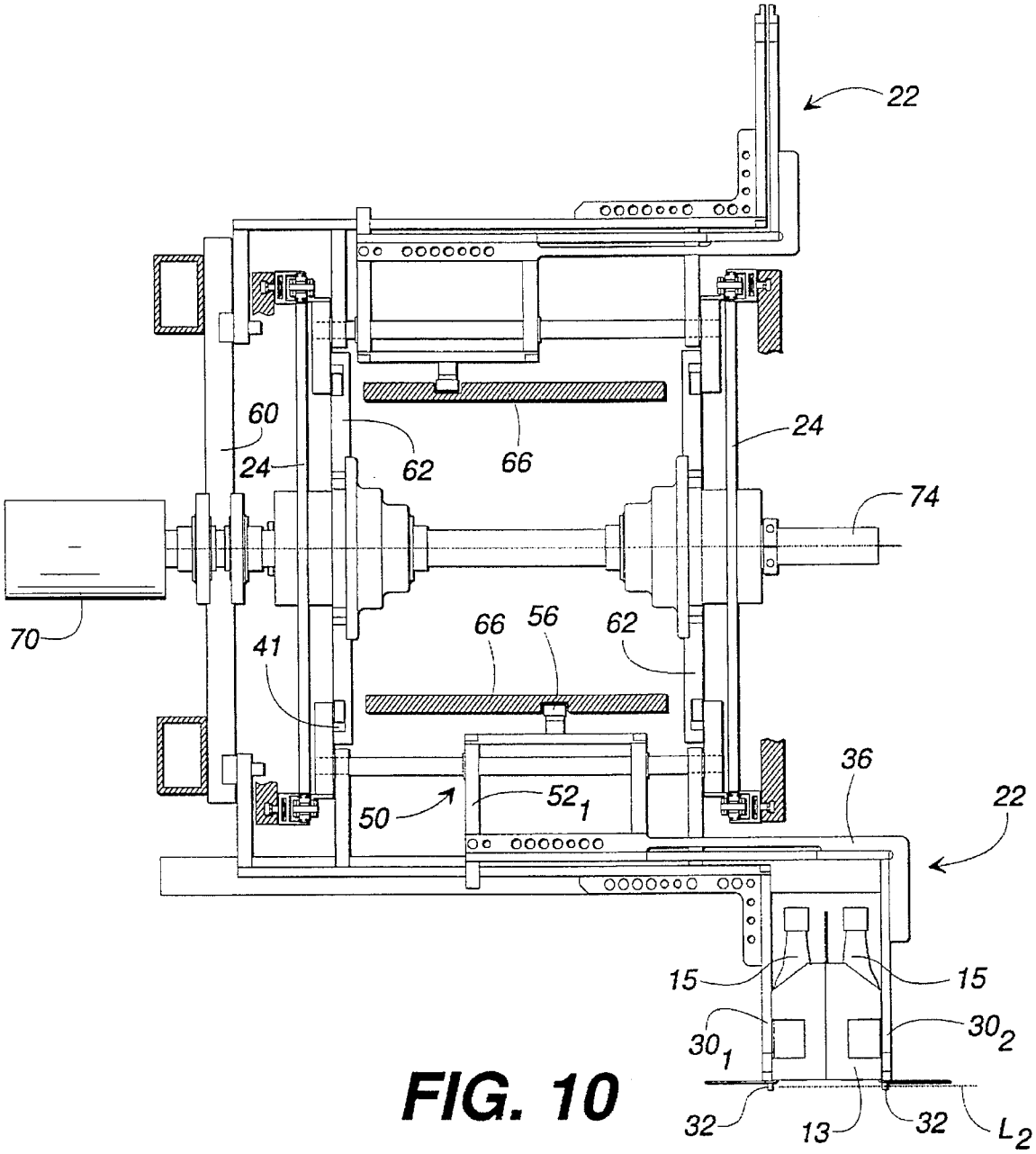
FIG. 10 is a front view of the overhead assembly of FIG. 1 with a carrier assembly in a fully opened and lowered onto an article group.

The carton 13 is completely lowered onto a group of articles 15 in a sixth zone VI of operation. As shown in FIG. 10, the carton 13 is placed over the articles 15 with the base of the carton 13 being lowered into the same plane as the base of the articles 15. The carton 13 is released from the fingers 32 in the sixth zone VI by the upward travel of the opening members $\mathbf{30}_1$ and $\mathbf{30}_2$ and the carrier assembly 22. During the release of the carton 13, as well as throughout the fourth IV, fifth V, sixth VI, and most of the third III zones of operation, the opening members $\mathbf{30}_1$ and $\mathbf{30}_2$ are maintained in a vertical orientation under the control of the attitude member 38. The attitude member 38 further maintains the opening members $\mathbf{30}_1$ and $\mathbf{30}_2$ in a vertical orientation even while the opening members $\mathbf{30}_1$ and $\mathbf{30}_2$ are being raised away from the articles 15. The paths of the cam grooves 61 and 63 are significant in this portion of the overhead assembly 20 since they cause the fingers 32 to enter into and lift straight out of the cut-outs 13*a* and clear the carton 13 during the rotation of the members $\mathbf{30}_1$ and $\mathbf{30}_2$ about the overhead assembly 20.

When the opening members $\mathbf{30}_1$ and $\mathbf{30}_2$ rotate up and away from the article conveyor 11, the carrier assembly 22 enters a seventh VII zone of operation. In the preferred embodiment, the opening members $\mathbf{30}_1$ and $\mathbf{30}_2$ are closed together to approximately one inch in an eighth VIII zone of operation. As will be apparent to those skilled in the art, however, the spacing of the opening members $\mathbf{30}_1$ and $\mathbf{30}_2$ is not significant in the seventh VII zone after the opening members $\mathbf{30}_1$ and $\mathbf{30}_2$ have cleared the carton 13 as well as in the eighth VIII zone and may vary from the exemplary disclosed distances.

The packaging machine 10 according to the invention utilizes three datum lines $L_1$ to $L_3$ in packaging articles 15 within a carton 13. Each of these three datum lines $L_1$ to $L_3$ is used by the packaging machine 10 in determining the position of an article group and the position of a carton 13. A first datum line $L_1$, shown in FIG. 8, is regularly spaced along the length of the article conveyor 11 after the articles 15 have been separated into individual article groups. The articles 15 are placed on the article conveyor 11 so that the trailing edge of the articles 15 within each group is aligned with the datum line $L_1$. Also, the carrier assemblies 22 are positioned relative to the datum line $L_1$ so that the opening members $\mathbf{30}_1$ and $\mathbf{30}_2$ are consistently located at a certain fixed distance away from the datum line $L_1$, and thus the rear edge of an article group. Thus, regardless of the length of an article group or the length of a carton 13, the packaging machine 10 can consistently align the rear edge of an article group with the rear edge of a carton 13.

With reference to FIGS. 6 and 7, a second datum line $L_2$ which is consistent for all sizes and shapes of cartons 13 and sizes or shapes of articles 15 is the base line. The second datum line $L_2$, or base line, is located at the base of a carton 13, which is also the base of the articles 15 and the upper surface of the article conveyor 11. The second datum line $L_2$ is also related to the operation of the carrier assemblies 22. More specifically, the opening members $\mathbf{30}_1$ and $\mathbf{30}_2$ must have a length selected so that the planar surface 35 of the members $\mathbf{30}_1$ and $\mathbf{30}_2$ will be approximately level with the article conveyor 11 when the carrier assemblies 22 are at their lowest position in their rotation about the overhead assembly 20. By selecting the base of the cartons 13 and articles 15 as the second datum line $L_2$, the packaging machine 10 can package articles 15 of various heights into cartons 13 of various heights. While the figures illustrate the second datum line $L_2$ as being aligned with both the base of the articles 15 and the panels of the carton 13, other applications of the invention may have the carton panels displaced relative to the base of the articles 15.

With reference to FIGS. 6 and 9, a third datum line $L_3$ which is consistent for all cartons 13 is a line extending parallel to the path of the articles 15. The third datum line $L_3$ is aligned with both the inner edge of an article group as well as the inner edge of an opened carton 13. Thus, the placement of the articles 15 on the conveyor 11 and the placement of the cartons 13 on the conveyor is coordinated so that the inner edges of both the articles 15 and cartons 13 are aligned with the third datum line $L_3$.

By using the above three datums, the packaging machine 10 according to the invention can package articles 15 of various sizes and configurations into cartons 13 of different widths, lengths, or heights. For instance, the opening members $\mathbf{30}_1$ and $\mathbf{30}_2$ can lower cartons of various lengths and may advantageously be fitted with a set of fingers that can flip down to engage additional cut-outs formed in the panels of the carton. The depth at which the opening members $\mathbf{30}_1$ and $\mathbf{30}_2$ travel may be adjusted by mounting the entire overhead assembly 20 on motor-driven jack screws. Also, the distance in which the opening members $\mathbf{30}_1$ and $\mathbf{30}_2$ are separated may be varied by having an adjustable opening cam 66. The adjustable opening cam 66 may be designed with a pivoting portion to accommodate the variations in opening distances. As will be apparent to those skilled in the art, the packaging machine 10 can be adjusted in a multitude of other ways.

The packaging machine 10 according to the invention can operate at higher speeds than conventional packaging machines. The overhead assembly 20 in the packaging machine 10 does not rely upon stiffness, crease strength, or vacuum position to open the cartons 13 but rather positively and physically opens the carton 13 by movement of the opening members $\mathbf{30}_1$ and $\mathbf{30}_2$. Because the cartons 13 are positively opened, the packaging machine 10 is better able to open cartons 13 having varying characteristics and having various levels of quality. For instance, the packaging machine 10 can open cartons which are relatively flimsy, old, or which have imperfections, such as glue spots or incomplete cuts. Thus, the packaging machine 10 according to the invention reduces the frequency of carton misfeed and consequently increases the efficiency of the packaging process.

While the invention has been described with reference to a carton 13 which is lowered onto an article group, the packaging machine 10 can operate with cartons that are placed at various locations along the height of the articles 15 or at positions above or below the articles 15. In general, the packaging machine 10 can package articles into any type of carton having two opposite panels which may be lowered onto an article group, such as clips, wraps, tamper-evident cartons, and neck-through cartons. Thus, if the carton is a clip, the opening members $\mathbf{30}_1$ and $\mathbf{30}_2$ may place the carton fairly close to the top of the articles 15. As should be apparent, the central portion of the carton need not be the walls of the carton but may comprise other surfaces. For instance, as discussed above, the central portion of the carton may comprise a part of a clip, part of the surface through which the necks of the articles pass, and may even be integral with one or both of the panels.

The packaging machine 10 according to the invention is also easily accessible. As best seen in FIG. 6, the overhead assembly 20 is located almost entirely on one side of the articles 15 and does not impede access to the articles 15 or to the cartons 13 traveling in the downstream direction. Thus, if a carton 13 or article 15 jam occurs, an operator can easily remove the jammed carton 13 or article 15 and quickly return the packaging machine 10 to its operative condition. Similarly, scheduled maintenance or necessary repairs can be more easily and quickly performed on the packaging machine 10. The amount of down time for the packaging machine 10 is therefore substantially reduced.

It will be obvious to those skilled in the art that many variations may be made in the above embodiment, here chosen for the purpose of illustrating the present invention, and full result may be had to the doctrine of equivalents without departing from the scope of the present invention, as defined by the appended claims.

For instance, while the packaging machine 10 has one opening member $\mathbf{30}_1$ fixed at an edge of the article group and then moves the other opening member $\mathbf{30}_2$ to open a carton 13, the packaging machine 10 could alternatively have the opening members $\mathbf{30}_1$ and $\mathbf{30}_2$ centered over the article groups and then move both of the opening members $\mathbf{30}_1$ and $\mathbf{30}_2$ to open the carton 13. Thus, the third datum line $L_3$ would be aligned with the center line of the article groups. Also, the length of the opening members $\mathbf{30}_1$ and $\mathbf{30}_2$ can be adjusted by replacing the opening members $\mathbf{30}_1$ and $\mathbf{30}_2$ with another set of members, by adding or removing pans, or by forming the members $\mathbf{30}_1$ and $\mathbf{30}_2$ in a retractable manner. Further, while the opening members $\mathbf{30}_1$ and $\mathbf{30}_2$ are released from the cartons by raising the carrier assemblies 22, the opening members $\mathbf{30}_1$ and $\mathbf{30}_2$ may be released from the cartons 13 by plows which bend the panels of the carton down and away from the opening members $\mathbf{30}_1$ and $\mathbf{30}_2$. It should be understood that the term opening "member" encompasses a wide range of structures, such as blades, and assemblies that are capable of engaging, positively opening, lowering, and releasing cartons onto article groups.

Also, the invention is not limited to the packaging of articles into 2×2 groups as shown but may package articles of various configurations. Thus, the packaging machine 10 according to the invention can package articles in a 1×2 configuration, a 2×3 configuration, a 3×3 configuration, etc. In fact, a packaging machine according to the invention could be used to place a carton onto an article group consisting of only one article. As will be apparent to those skilled in the art, the distance that the opening members $\mathbf{30}_1$ and $\mathbf{30}_2$ are separated depends upon the specific article configuration and, more specifically, on the width of the article group as measured along axis B.

What is claimed is:

1. An overhead assembly for use in a packaging machine moving an article group in a downstream direction and placing a carton in a predetermined configuration wherein a pair of panels are oriented on either side of a central portion of the carton, said overhead assembly comprising:

a carrier assembly having a pair of opening members;

means for driving said carrier assembly in said downstream direction and for lowering the carrier assembly onto the carton, said opening members engaging the panels of the carton;

means for separating said opening members away from each other to open the carton;

means for lowering the carrier assembly toward said article group and lowering said opening members toward the article group, said lowering means positioning the opening members of the carrier assembly so that the carton is placed onto the article group; and means for raising the carrier assembly away from the article group after the carton has been placed onto the article group by said lowering means, the opening members disengaging the carton during the raising of said carrier assembly.

2. The overhead assembly as set forth in claim 1, wherein said opening members include features for being inserted within cut-outs formed in the panels of the carton.

3. The overhead assembly as set forth in claim 1, further comprising attitude control means for maintaining said opening members in a vertical orientation while said driving means lowers the carrier assembly onto the carton, while said lowering means lowers the opening members on either side of the article group, and while said raising means causes said opening members to disengage from the carton.

4. The overhead assembly as set forth in claim 3, wherein said attitude control means comprises an attitude cam plate and said carrier assembly has an attitude cam follower for traveling within a cam groove in said attitude cam plate, said attitude cam plate and said attitude cam follower controlling a pivoting of said opening members about a pivot shaft in said carrier assembly.

5. The overhead assembly as set forth in claim 1, wherein said separating means comprises an opening cam plate having a cam groove; and the carrier assembly further comprises an opening cam follower for traveling within said cam groove, a fixed carrier bar from which one of said opening members depend, a moveable carrier bar from which the other of said opening members depend, and a yoke assembly interconnecting said opening cam follower to said moveable carrier bar:

wherein said opening cam follower, said yoke assembly, and said moveable carrier bar cause the other opening member to move in a direction transverse to said downstream direction when said cam groove extends in said direction transverse to said downstream direction.

6. The overhead assembly as set forth in claim 1, wherein said driving means comprises a chain which is connected to the carrier assembly, a pair of spaced sprockets about which said chain is wrapped, and a motor for rotating one of said sprockets.

7. The overhead assembly as set forth in claim 1, wherein said driving means, lowering means, and raising means comprise a cam plate having a cam groove and said carrier assembly comprises a cam follower for traveling within said cam groove, a path of said cam groove determining an attitude and position between said carrier assembly and said articles and between said carrier assembly and said carton.

8. The overhead assembly as set forth in claim 1, wherein said lowering means lowers said carrier assembly so that said opening members place the panels at a base of said articles.

9. The overhead assembly as set forth in claim 1, wherein said overhead assembly comprises a plurality of carrier assemblies for lowering cartons onto a plurality of article groups.

10. The overhead assembly as set forth in claim 9, wherein said lowering means alters a pitch of said carrier assemblies to equal a pitch of said article groups.

11. The overhead assembly as set forth in claim 1, wherein said separating means opens said carton to approximately twice an outer diameter of said articles.

12. The overhead assembly as set forth in claim 1, wherein said opening members are inserted into said panels which are substantially horizontally oriented when said carton is in said predetermined configuration.

13. The overhead assembly as set forth in claim 1, wherein said opening members engage said panels of said carton when said central portion of said carton is substantially vertically oriented.

14. The overhead assembly as set forth in claim 1, wherein said separating means separates the opening members so that the carton is completely opened.

15. A method of packaging articles with a packaging machine that moves an article group in a downstream direction and places a carton in a predetermined configuration onto a carton conveyor wherein a pair of panels are located on either side of a central portion of the carton, said method comprising the steps of:

driving a carrier assembly having a pair of opening members in said downstream direction, lowering the carrier assembly onto the carton, and engaging the opening members from said carrier assembly with the panels;

separating the opening members from each other and opening the carton;

placing the carton on the group of articles by moving said carrier assembly toward said articles and positioning said opening members on either side of the group of articles; and after the carton has been placed onto the article group, raising said carrier assembly away from the article group and disengaging the opening members from the carton.

16. The method as set forth in claim 15, further comprising the step of maintaining said opening members vertically oriented during said placing, raising and disengaging steps.

17. The method as set forth in claim 16, wherein said step of maintaining includes the step of controlling an attitude of the carrier assembly based on a position of an attitude cam follower on the carrier assembly within a cam groove in an attitude cam plate.

18. The method as set forth in claim 15, wherein said step of separating includes the step of moving one of said opening members away from the other of the opening members.

19. The method as set forth in claim 15, wherein said step of engaging comprises the step of inserting features on said opening members into cut-outs formed in the panels of the carton.

20. The method as set forth in claim 15, wherein said driving step includes the step of adjusting an attitude and position between the carrier assembly and the carton based on a position of cam follower on the carrier assembly within a cam groove in a cam plate.

21. The method as set forth in claim 15, wherein said separating step includes the step of adjusting a distance between the opening members based on a position of an opening cam follower on the carrier assembly within a cam groove in an opening cam plate.

22. The method as set forth in claim 15, wherein said placing and positioning steps include the step of lowering said opening members so that the panels of the cartons are lowered to a base of the articles.

23. The method as set forth in claim 15, further comprising the steps of driving a plurality of carrier assemblies in said downstream direction, engaging a carton with each one of the carrier assemblies, and lowering the cartons onto article groups.

24. The method as set forth in claim 23, wherein said moving and positioning steps include the step of adjusting a pitch of said carrier assemblies to equal a pitch of said article groups.

25. The method as set forth in claim 15, wherein said step of engaging said opening members with said panels comprises the step of engaging said opening members with panels which are substantially horizontally oriented.

26. The method as set forth in claim 15, wherein said step of engaging said opening members with said panels comprises the step of engaging said opening members with panels when said central portion is substantially vertically oriented.

27. The method as set forth in claim 15, wherein said step of separating comprises the step of separating said opening members by a distance approximately equal to twice an outer diameter of said articles.

28. The method as set forth in claim 15, wherein said step of separating includes the step of separating said opening members until the carton is completely opened.

29. An overhead assembly for use in a packaging machine moving article groups in a downstream direction and placing cartons in a predetermined configuration onto a carton conveyor wherein a pair of panels of the cartons are oriented on either side of a central portion of the carton, said overhead assembly comprising:

a first cam plate having a first cam groove;

a plurality of carrier assemblies each having a pair of opening members and first cam followers for traveling within said first cam groove;

a chain attached to each of the carrier assemblies and looped partially around a pair of spaced sprockets;

means for rotating one of said sprockets to cause the chain and the carrier assemblies to rotate about said overhead assembly;

wherein:

the opening members in the carrier assemblies become engaged with the panels on the cartons during a rotation of said carrier assemblies about said overhead assembly;

said first cam plate, said first cam groove, and said first cam follower move the opening members away from each other to open the cartons; and rotation of said chain about said overhead assembly further causes the carrier assemblies to be lowered toward article groups so that the cartons held by the opening members are placed on the article groups.

30. The overhead assembly as set forth in claim 29, further comprising a second cam plate, a second cam groove, and each carrier assembly further comprises a second cam follower for traveling in said second cam groove and a pivot shaft, said second cam plate, said second cam groove, and said second cam follower controlling a pivoting of said opening members about said carrier shaft.

31. The overhead assembly as set forth in claim 30, wherein said second cam plate, said second cam groove, and said second cam follower maintain said opening members in a vertical orientation while said carrier assemblies are lowered into engagement with the cartons.

32. The overhead assembly as set forth in claim 30, wherein said second cam plate, said second cam groove, and said second cam follower maintain said opening members in a vertical orientation while said carrier assemblies place the cartons on the article groups.

33. The overhead assembly as set forth in claim 29, wherein said rotating means, said chain, and one of said sprockets raise the carrier assemblies away from the article groups after the cartons have been placed on the article groups.

34. The overhead assembly as set forth in claim 33, further comprising a second cam plate, a second cam groove, and a second cam follower on said carrier assemblies for maintaining said opening members in a vertical orientation while said carrier assemblies are raised away from the article groups.

35. The overhead assembly as set forth in claim 29, wherein said opening members are sized to place the panels of the cartons at a base of said articles.

36. The overhead assembly as set forth in claim 29, wherein said first cam plate, said first cam groove, and said first cam follower separate said opening members so that the cartons are completely opened.

* * * * *